US008464785B2

(12) United States Patent
Carbaugh et al.

(10) Patent No.: US 8,464,785 B2
(45) Date of Patent: Jun. 18, 2013

(54) PIPE GUIDE ARMS FOR BLIND SHEAR RAMS

(75) Inventors: William L. Carbaugh, Humble, TX (US); Leonard G. Childers, Houston, TX (US); Viral Shah, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 0 days.

(21) Appl. No.: 13/339,519

(22) Filed: Dec. 29, 2011

(65) Prior Publication Data

US 2012/0318493 A1 Dec. 20, 2012

Related U.S. Application Data

(60) Provisional application No. 61/496,835, filed on Jun. 14, 2011.

(51) Int. Cl.
*E21B 43/11* (2006.01)
*E21B 33/06* (2006.01)

(52) U.S. Cl.
USPC ..... 166/55; 166/85.4; 251/1.3

(58) Field of Classification Search
USPC ..... 166/85.4, 85.5, 55; 251/1.3
See application file for complete search history.

(56) References Cited

U.S. PATENT DOCUMENTS

| | | | | |
|---|---|---|---|---|
| 4,313,496 | A * | 2/1982 | Childs et al. | 166/55 |
| 4,537,250 | A * | 8/1985 | Troxell, Jr. | 166/55 |
| 4,646,825 | A * | 3/1987 | Van Winkle | 166/55 |
| 4,770,387 | A * | 9/1988 | Granger | 251/1.3 |
| 5,515,916 | A | 5/1996 | Haley | |
| 6,173,770 | B1 * | 1/2001 | Morrill | 166/85.4 |
| 6,244,336 | B1 * | 6/2001 | Kachich | 166/55 |
| 7,121,348 | B2 | 10/2006 | Hemphill et al. | |
| 7,234,530 | B2 | 6/2007 | Gass | |
| 7,243,713 | B2 * | 7/2007 | Isaacks et al. | 166/85.4 |
| 7,354,026 | B2 * | 4/2008 | Urrutia | 251/1.3 |
| 7,464,765 | B2 * | 12/2008 | Isaacks et al. | 166/378 |
| 7,703,739 | B2 | 4/2010 | Judge et al. | |
| 8,066,070 | B2 * | 11/2011 | Springett et al. | 166/298 |
| 2008/0196888 | A1 | 8/2008 | Judge et al. | |

* cited by examiner

*Primary Examiner* — Jennifer H Gay
*Assistant Examiner* — Michael Wills, III
(74) *Attorney, Agent, or Firm* — Bracewell & Giuliani LLP

(57) ABSTRACT

A pipe shear ram assembly has a housing having a bore extending vertically therethrough for the passage of a pipe string. Ram blocks have blades positioned such that one slides over the other when the first and second ram blocks are moved toward each other to shear a well pipe. A pair of guide arms extend from one of the rams. The guide arms have tips protruding a greater distance than the blade. Each of the guide arms has an inboard wedge surface beginning at the tip and extending along a line that intersects the longitudinal axis for guiding the pipe string toward a bore axis of the bore in the event the first and second ram blocks are moved to the closed position.

19 Claims, 5 Drawing Sheets

PIPE GUIDE ARMS FOR BLIND SHEAR RAMS

CROSS-REFERENCE TO RELATED APPLICATION

This application claims priority to provisional application Ser. No. 61/496,835, filed Jun. 14, 2011.

FIELD OF THE DISCLOSURE

This disclosure relates in general to well drilling and in particular to a shear ram assembly for a blowout preventer ("BOP") that has guide arms to move a well pipe away from a side wall of the bore of the shear ram assembly during shearing.

BACKGROUND OF THE DISCLOSURE

Offshore drilling rigs normally employ a riser to connect the subsea wellhead with the drilling rig. A blowout preventer is located at a lower end of the riser. Land rigs also use blowout preventers. A blowout preventer is a large assembly having many features for closing the riser in the event high pressure in the wellbore begins pushing the drilling mud upward. Those features include an annular blowout preventer that seals around pipe regardless of the diameter. The blowout preventer also has pipe rams that are sized to close and seal around pipe strings of certain diameters. The blowout preventer also has shear rams that will shear a drill pipe string or a production tubing string in the event of an emergency.

Pipe shear rams have two rams, each of which has a blade mounted to it. Pistons move the rams toward each other to shear pipe extending through the blowout preventer. One blade is located at a higher elevation than the other and slides over the lower one when the shear rams close. Often the pipe string will be off-centered relative to the axis of the bore extending through the shear ram assembly. The blades have converging side portions that lead to a central area for centering the pipe as the rams close. In some pipe ram assemblies, a remote possibility exists that the pipe string will remain at an outside wall of the bore during closure, which could lead to incomplete shearing of the pipe string.

SUMMARY

The pipe shear ram assembly has a housing with a bore extending vertically for the passage of a pipe string. The assembly has first and second ram blocks, each having a blade, the blades being positioned such that one slides over the other when the first and second ram blocks are moved forward to a closed position. Two guide arms protrude from the first ram block toward the second ram block. Each of the guide arms has a tip and a wedge surface on an inboard side extending rearward from the tip. The wedge surfaces are farther apart from each other than the blade and guide the pipe string toward an axis of the bore in the event the first and second ram blocks are moved to the closed position.

In one embodiment, a rearward edge of each of the wedge surfaces is located substantially the same distance forward of a face of the first ram block as an upper edge of an outboard end of the blade of the first ram block. Preferably each of the wedge surfaces is located in a vertical plane. A distance between rearward ends of the wedge surfaces is less than a diameter of the bore in one embodiment. Each of the wedge surfaces may be flat.

Each of the blades may have a length between outboard ends that is less than a diameter of the bore. A pair of recesses are located on the second ram block adjacent opposite ends of the blade of the second ram block for receiving the guide arms when the first and second ram blocks move to the closed position. Each of the recesses has an upper wall. The guide arms are mounted to the first ram block so as to avoid sliding contact with the upper walls as the ram blocks move to the closed position. The bottoms and outboard sides of the recesses may be open. In one embodiment, the blade of the first ram block slides over the blade of the second ram block when in the closed position.

DETAILED DESCRIPTION

Figure 1:
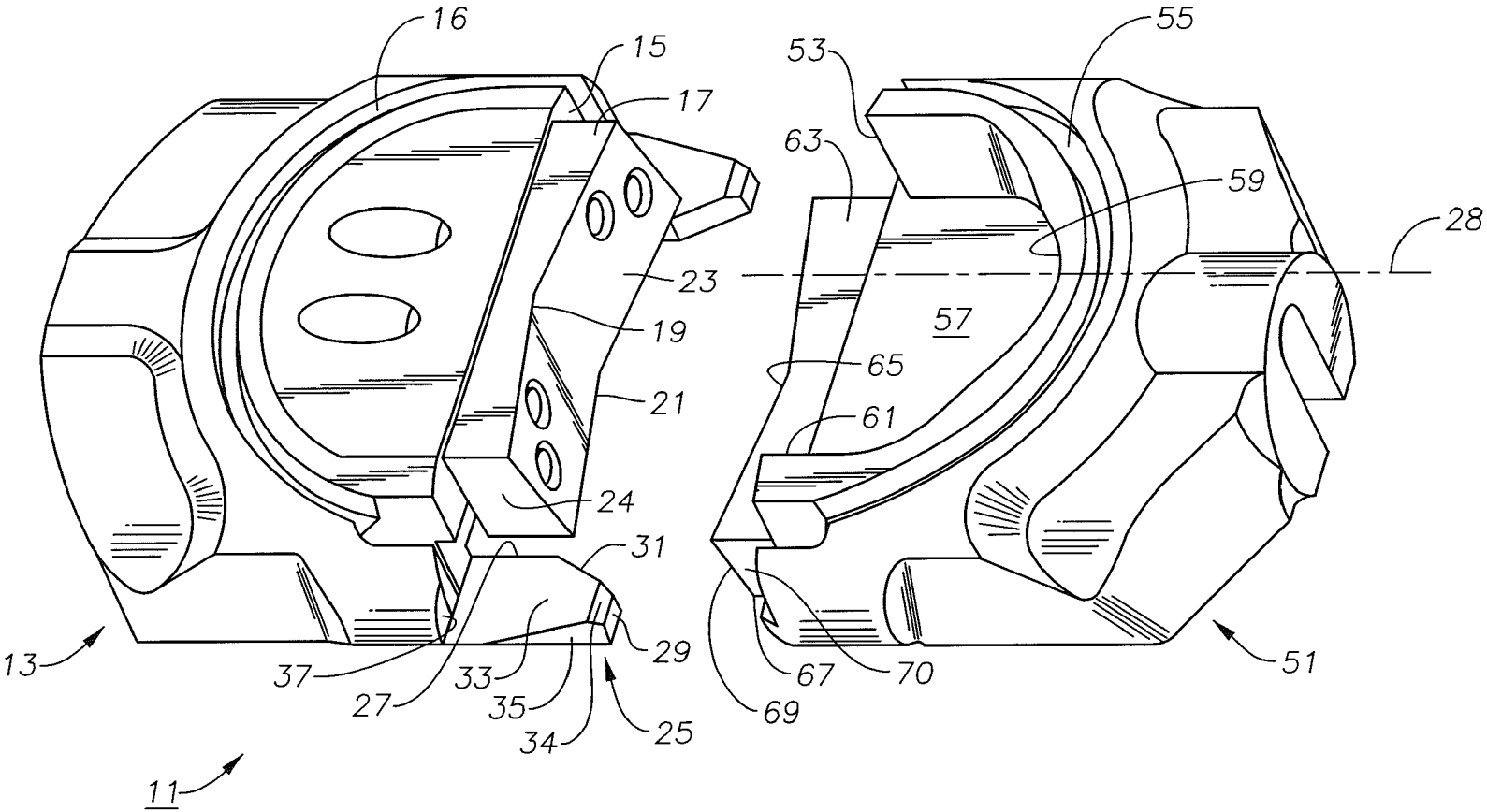
FIG. 1 is a perspective view of the ram blocks of a shear ram assembly in accordance with this disclosure.

Referring to FIG. 1, shear rams 11 are shown removed from the housing or bonnet in which they are located. Shear rams 11 are part of a ram BOP assembly that is part of a stack assembly. In the case of offshore drilling, the stack assembly is located at the lower end of a riser extending downward from a drilling vessel. The lower end of the BOP stack assembly secures to a subsea wellhead on the sea floor. The BOP stack assembly will normally also contain pipe rams, variable bore rams, and a quick disconnect mechanism for disconnecting from the riser in the event of an emergency. When actuated, shear rams 11 will close the through bore and also shear pipe in the well, such as drill pipe, tubing, or casing.

Shear rams 11 include an upper ram assembly 13 having a face or forward end 15. A semi-circular seal groove 16 is located on the upper side of upper ram block 13 for receiving a portion of an elastomeric seal. An upper shearing blade 17 mounts to forward end 15. Upper blade 17 has a forward face 23 with an upper edge 19 and a lower edge 21. Lower edge 21 extends forward farther from forward end 15 than upper edge 19 in this example, resulting in face 23 inclining relative to vertical. Face 23 is also generally concave or converging, resulting in the center of face 23 between its outboard ends 24 being recessed relative to the more forward portions of face 23 at outboard ends 24. A variety of different shapes for upper blade 17 may be employed.

Pipe guide arms 25 are located on the outboard sides of upper ram block forward end 15. Each arm 25 could be formed integrally with upper ram block 13, or they could be otherwise attached, such as by welding or fasteners. Each arm 25 has a vertically oriented inboard side 27 extending forward from a base 37 of each arm 25. Base 37 is designated to be where arm 25 joins forward end 15. Also each arm 25 has a forward end or tip 29. A wedge surface 31 extends from a junction with a forward end of inboard side 27 to tip 29. Each inboard side 27 is parallel with a longitudinal axis 28 of shear rams 11 in this example. Wedge surface 31 may be a flat vertical surface, as shown, that is at an acute angle relative to longitudinal axis 28. In this embodiment, wedge surface 31 is at an angle of about 30 degrees relative to longitudinal axis 28 and to inboard side 27. Rather than flat, wedge surface 31 could be a curved surface. Each guide arm 25 has an upper side 33 that is flat and in a horizontal plane in this example. A chamfer or bevel 34 optionally may be at the intersection of upper side 33 with tip 29.

Figure 2:
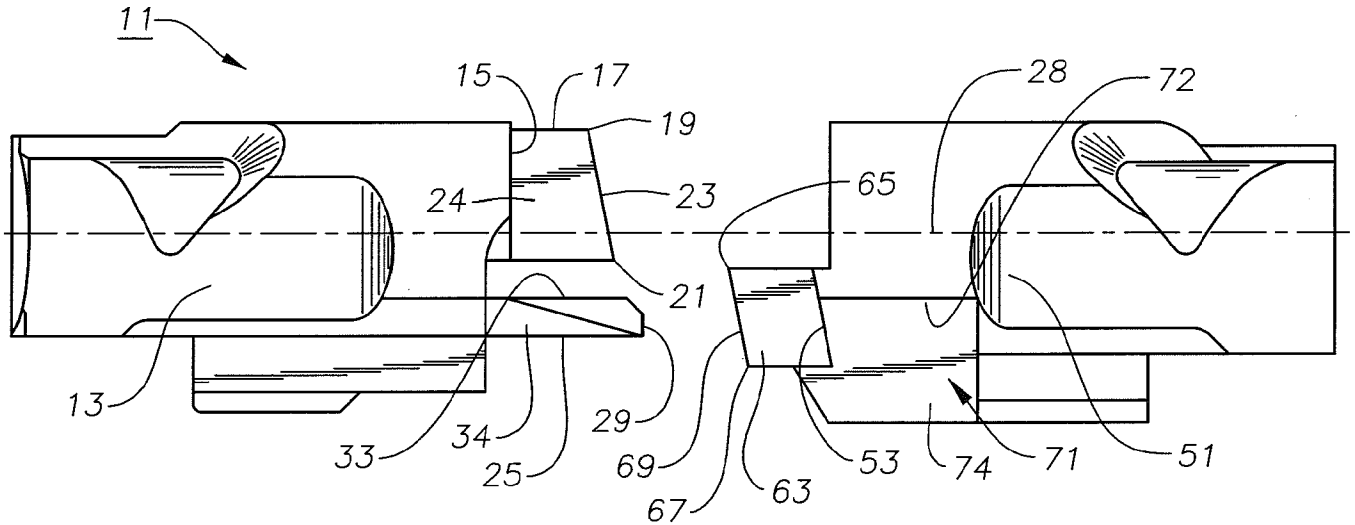
FIG. 2 is a side view of the ram blocks of FIG. 1.
Figure 3:
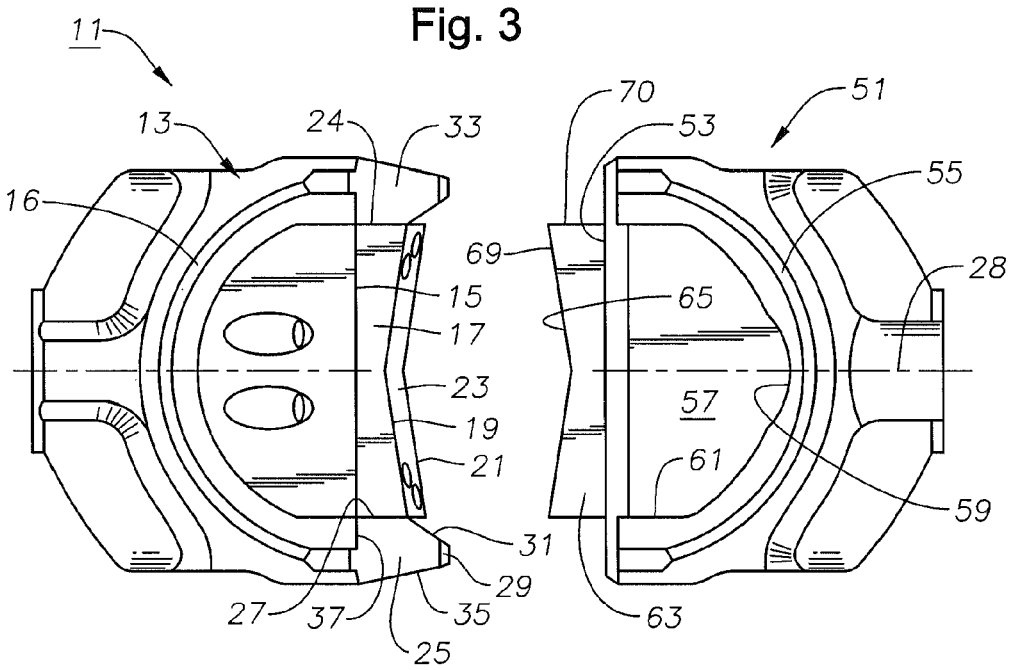
FIG. 3 is a top view of the ram blocks of FIG. 1.

As shown in FIG. 2, upper side 33 is spaced at a lower elevation on upper ram block forward end 15 than upper blade lower edge 21. Upper side 33 is not located directly under upper blade 17 in this example because inboard side 27 of each arm 25 is approximately the same outboard distance as one of the upper blade outboard ends 24, as shown in FIG. 3. Also, FIGS. 2 and 3 illustrate that tip 29 extends forwardly more than upper blade 17 from forward end 15. The junction of inboard side 27 with wedge surface 31 is approximately in vertical alignment with the junction of upper shear blade upper edge 19 and outboard end 24. Wedge surface 31 joins inboard side 27 approximately the same distance from upper ram block forward end 15 as the distance from forward end 15 to the upper edge 19 of upper blade face 23 at outboard end 24.

Each guide atm 25 has an outboard side 35 that extends from arm base 37 to tip 29. Outboard side 35 may be at an acute angle relative to longitudinal axis 28. In this embodiment, the acute angle is about 15 degrees relative to longitudinal axis. Tip 29 has a smaller height and width than base 37.

Figure 4:
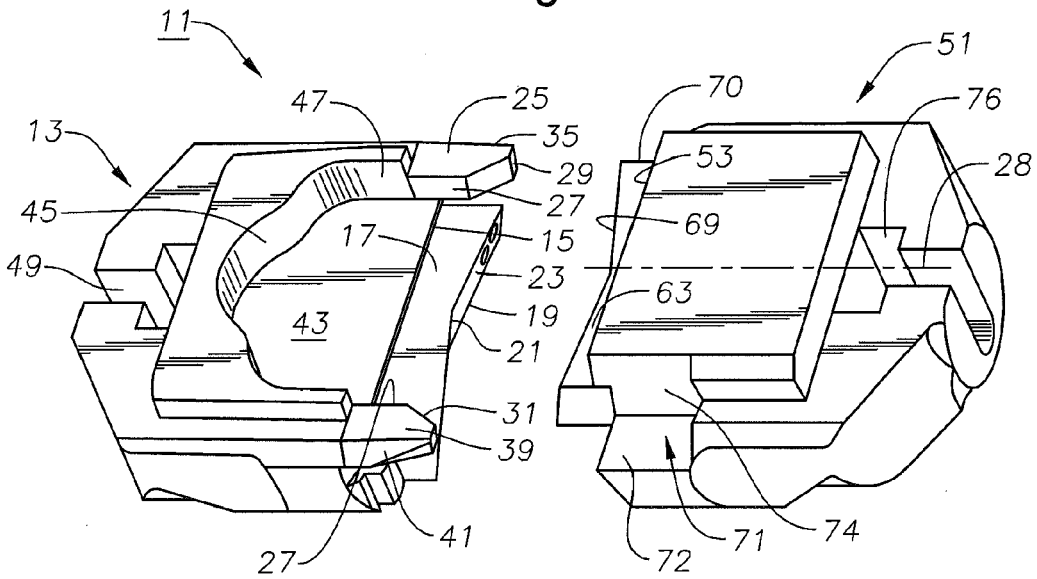
FIG. 4 is a bottom perspective view of the ram blocks of FIG. 1.

FIG. 4 shows a lower side 39 of each arm 25. Lower side 39 is shown as being flat and in a plane parallel with upper side 33 (FIG. 3). A beveled surface 41 may join an outboard edge of lower side 39 with outboard side 35. Beveled surface 41 is shown to be in a plane inclined relative to horizontal.

Figure 5:
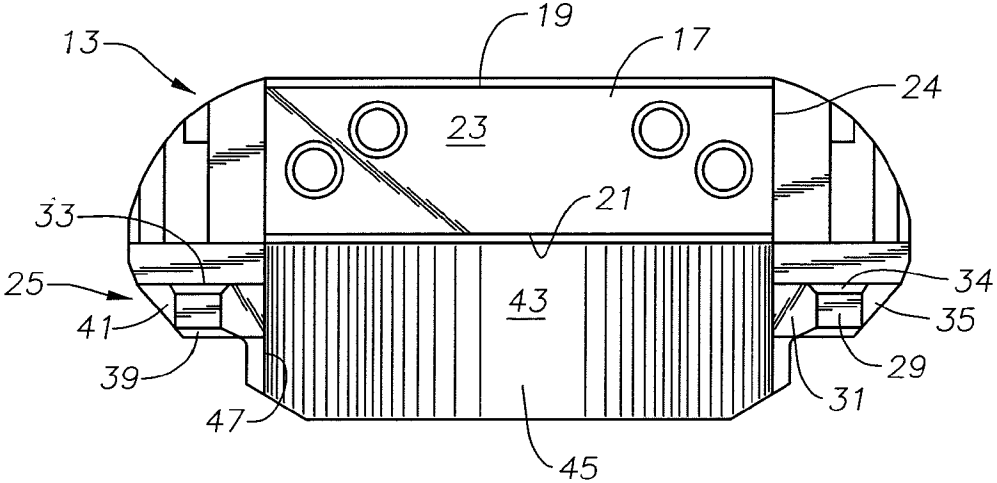
FIG. 5 is a front view of the upper ram block of FIG. 1.

Referring still to FIG. 4, and also to FIG. 5, the lower side of upper ram block 13 has a sheared pipe end recess 43. Recess 43 has a rear wall portion 45 that joins side wall portions 47. Wall portions 45 and 47 are vertical walls positioned to receive the upper end of a well pipe after it has been sheared. Rearward wall portion 45 is illustrated as being partially cylindrical and blends with side wall portions 47, which are straight. Other shapes for shear pipe end recess 43 are feasible. FIG. 4 also illustrates a T-shaped connector slot 49 on the rearward end of upper ram block 13 for connecting to a piston rod.

Referring again to FIG. 1, a lower ram block 51 is illustrated in horizontal alignment with upper ram block 13. Lower ram block 51 has a forward end 53 that is parallel to forward end 15 of upper ram block 13. A top seal groove 55 in the upper side of lower ram block 51 receives an elastomeric seal and aligns with seal groove 16 to form a continuous seal when ram blocks 13, 51 are in abutment with each other. The seal is not necessarily circular. Lower ram block 51 has a sheared pipe end recess 57 for receiving the lower end of well pipe after shearing. Sheared pipe end recess 57 has a curved rear wall portion 59 that blends with two straight side wall portions 61. Other shapes are feasible.

A lower blade 63 attaches to forward end 53 of lower ram block 51. Lower blade 63 is at a lower elevation than upper blade 17, as illustrated in FIG. 2. Lower blade 63 slides under upper blade 17 when shearing. An upper edge 65 of lower blade 63 is at a slightly lower elevation than lower edge 21 of upper blade 17. Lower blade 63 has a lower edge 67 that is closer to lower block forward end 53 than the upper edge 65. A face 69 extends between lower edge 67 and upper edge 65 and is thus inclined relative to vertical. As illustrated in FIG. 2, in this example, the inclination of lower blade face 69 is the same as the inclination of upper blade face 23. Lower blade face 69 also recesses or converges to a central area that is closer to lower block forward end 53 than the outboard ends 70 of lower blade 63, as shown in FIGS. 1 and 3. The length of lower blade 63 from one outboard end 70 to the other is the same as the length of upper blade 17 from one outboard end 24 to the other.

Referring to FIG. 4, which shows the bottom of lower block 51, a recess 71 is located on lower shear block 51 along each outboard side outward and rearward from lower blade outboard ends 70. Each recess 71 comprises a space or clearance provided along an outboard side to receive one of the arms 25 when ram blocks 13, 51 are closed. Each recess 71 is defined by a downward-facing upper side wall 72 and an inboard side wall 74, side walls 72 and 74 being flat and perpendicular in this example. Each recess 71 is aligned with one of the arms 25 to receive the arm when in the closed or sheared position. Each recess 71 has a greater longitudinal length than the length of each arm 25. Also, upper side wall 72 has a greater width than each arm 25, and inboard side wall 74 has a greater height than the height of each arm 25 from its lower side 39 to its upper side 33 (FIG. 2). Recess 71 is not a closed cavity as it has no outboard side wall or bottom side wall. There is no interference between upper side wall 72 and upper side 33 (FIG. 2) of arm 25. There is no interference between inboard side 27 of arm 25 and inboard side wall 74. Arm upper side 33 could optionally slidingly engage recess upper side wall 74, but preferably no significant vertical forces would be created on lower ram block 51 as a result.

A vertical center point of each arm 25 is approximately the same as a vertical center of lower blade 63. When moving to the closed or sheared position, lower blade 63 will slide between the two arms 25 as the arms enter recesses 71. The outboard ends 70 of lower blade 63 will be closely spaced from the inboard sides 27 of arms 25 as the arms enter recesses 71. A T-shaped connector slot 76 for connection to a piston rod is located on the rearward end of lower block 51.

Figure 6:
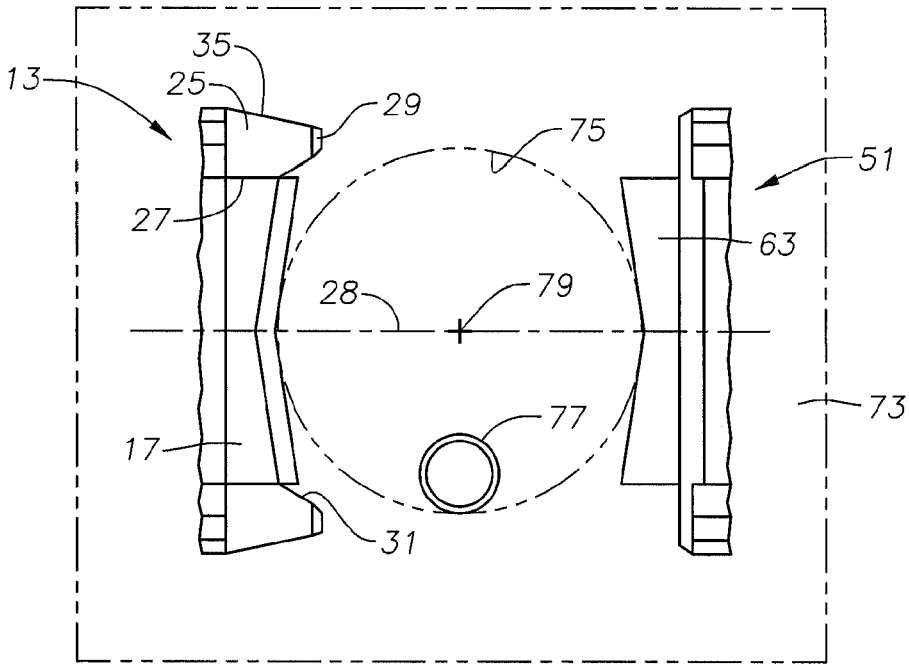
FIG. 6 is a top view of the blades and guide arms of the ram blocks of FIG. 1, shown in an open position.
Figure 7:
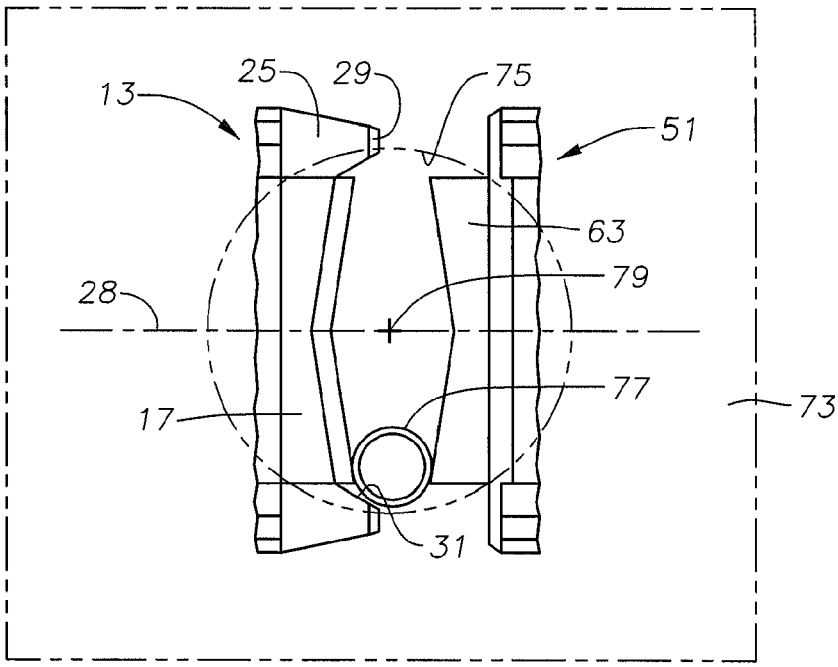
FIG. 7 is a top view of the blades and guide arms of FIG. 6, shown in a partially closed position.

Referring to FIGS. 6 and 7, a housing or bonnet 73 for shear rams 11 is illustrated schematically by dotted lines. Shear ram blocks 13, 51 (only a portion shown) are mounted in bonnet 73 and move toward and away from each other along axis 28 by pistons not shown). A vertical opening or bore 75 extends through bonnet 73. The lengths of blades 17, 63 are somewhat less than the diameter of bore 75. The distance between arm tips 29, measured from the inside surface of each arm tip 29, is approximately the diameter of bore 75. Stated another way, the distance between wedge surfaces 31, measured at the forward ends of wedge surfaces 31, is approximately the diameter of bore 75. The distance between the rearward ends of wedge surfaces 31, is approximately the same as the length of blade 17 and less than the diameter of bore 75. Bore 75 has the same diameter as the riser pipe (not shown) attached to bonnet 73 for receiving well pipe 77 extending from the vessel into the wellbore.

Well pipe 77 may be of various diameters depending on the purpose and type of the pipe. Well pipe 77 could coincide with bore axis 79 or be offset to one side as illustrated. A side of well pipe 77 could be touching a side portion of bore 75, particularly if buckling of well pipe 77 has occurred in the wellbore.

FIG. 6 shows shear rain blocks 13, 51 fully open. While fully open, no portion of blades 17, 63 or arms 25 will protrude into bore 75. FIG. 7 shows shear ram blocks 13, 51 in the process of being closed to shear pipe 77. As blades 17, 63 advance into bore 75, the guide arms 25 contact well pipe 77 and help pipe 77 to move towards bore axis 79. The wedge surfaces 31 makes sure that any part of well pipe 77 placed anywhere in bore 75 can be brought within range of the shear blades to be completely sheared. The full diameter of well pipe 77 will be contacted by blades 17 and 63. When blade 17 is located midway across bore 75, there will be no large gap between outboard ends 24 of blade 17 and the sides of bore 75 as the gaps will be filled by arms 25.

The shear ram assembly 11 as described will shear a pipe string 77 when closed, even if the pipe string 77 is initially located against an outside wall of the housing bore 75. The pipe string 77 will not be pushed outward to a position resulting in an incomplete shearing. The guide arms 25 provide two functions. The first is to push or direct the pipe string 77 toward the center of the bore 75. The second is to remove or support the side load on the cutting blade 77 when the pipe string 77 is off center.

Figure 8:
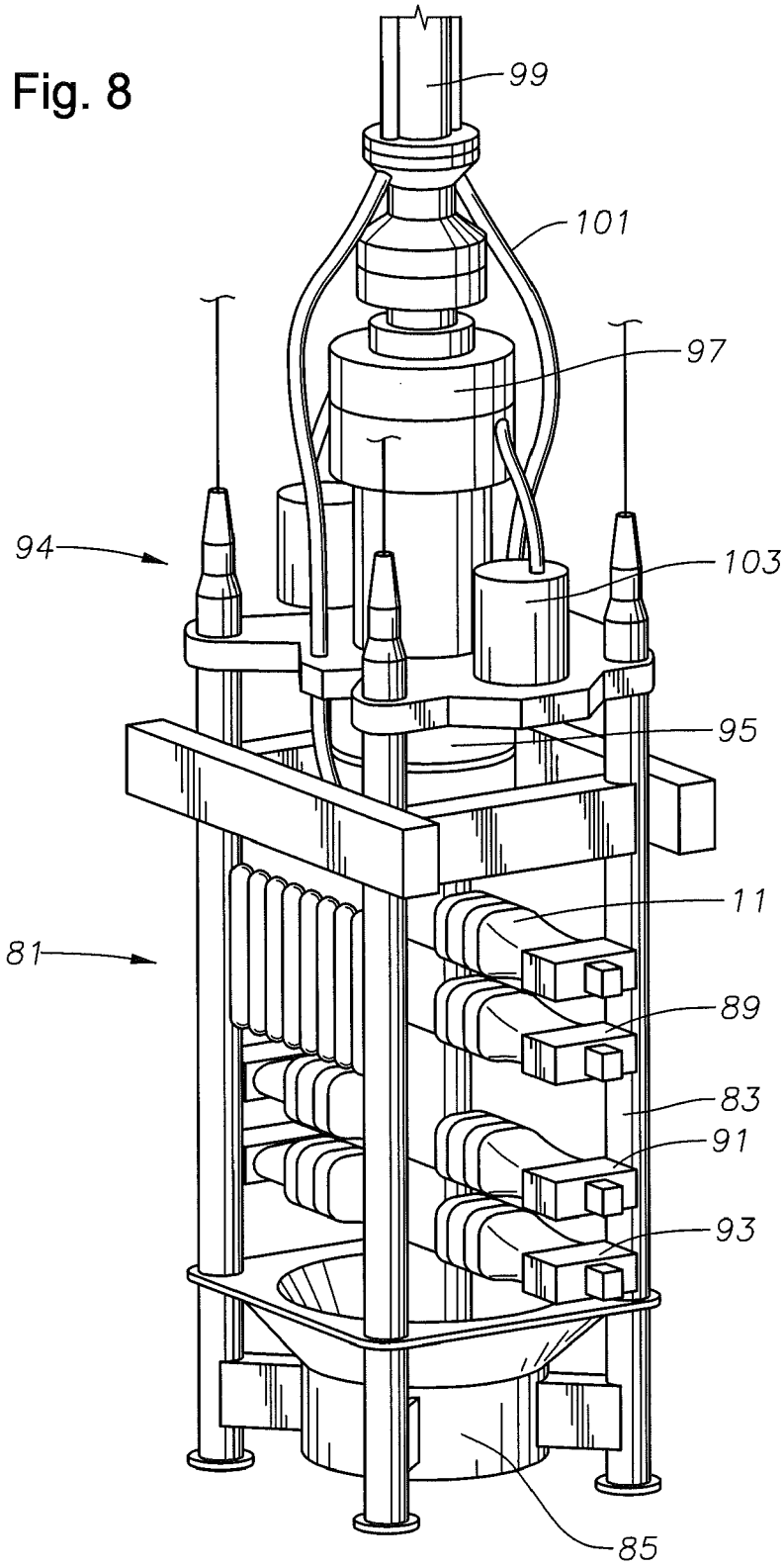
FIG. 8 is a perspective view of the ram blocks of FIG. 1 installed within a subsea blowout preventer assembly.

FIG. 8 shows blind shear rams 11 installed within a typical subsea blowout preventer assembly. The blowout preventer assembly has a blowout preventer ("BOP") stack 81 that includes a frame with a wellhead connector 85 at the lower end for connecting to a subsea wellhead assembly (not shown). Blind shear rams 11 are normally located above pipe rams, which in this example includes pipe rams 91, 93, and 95. Each pipe ram 91, 93 and 95 has rams with semi-cylindrical recesses on the mating faces for closing around a different size range of pipe. When closed, blind shear rams 11 will seal off the bore and if pipe is present, will shear the pipe.

A lower marine riser package (LMRP) 94 connects to the upper end of BOP stack 81. An annular BOP 95 may be located at the lower end of LMRP 94. Annular BOP 95 will close around any size of pipe and seal the annulus between the pipe and the side wall of the bore. Annular BOP 95 will also seal fully even if a pipe is not present. A flex joint 97 is located at the upper end of LMRP 94 to allow flexing of a lower end of a riser string 99 connected to flex joint 97. Choke and kill lines 101 extend from below annular blowout preventer 95 to alongside riser 99 for pumping fluid into the well. In the event of an emergency, LMRP 94 and riser 99 can be detached from BOP stack 81. Redundant control pods 103 mount to LMRP 94 and contain hydraulic and electrical circuitry for controlling movement of the various rams 11, 81, 91 and 93 annular BOP 95 and other equipment. Control pods 103 are retrievable from LMRP 94 and are connected to an umbilical (not shown) leading to the drilling vessel at the surface.

While the shear ram assembly has been shown in only one of its forms, it should be apparent to those skilled in the art that it is not so limited but is susceptible to various changes without departing from the scope of the disclosure.

The invention claimed is:

1. A pipe shear ram assembly, comprising:

a housing having a bore extending vertically therethrough for the passage of a pipe string and having a bore axis;

first and second ram blocks, having first and second blades, respectively, the blades being positioned such that one slides over the other when the first and second ram blocks are moved forward to a closed position;

a pair of guide arms protruding from the first ram block toward the second ram block, each of the guide arms being axially spaced from the first blade and located at a different elevation on the first ram block than the first blade; and each of the guide arms having a tip and a wedge surface on an inboard side of each of the guide arms, each of the wedge surfaces extending from the tip toward the first ram block to a rearward end of each of the wedge surfaces, each of the wedge surfaces being devoid of additional aligning structure from the tip to the rearward end for contacting and guiding the pipe string toward the bore axis of the bore in the event the first and second ram blocks are moved to the closed position.

2. The assembly according to claim 1, wherein the rearward end of each of the wedge surfaces is located substantially a same distance forward of a face of the first ram block as an upper edge of an outboard end of the first blade.

3. The assembly according to claim 1, wherein a distance between the rearward ends of the wedge surfaces is substantially equal to a length of the first blade.

4. The assembly according to claim 1, wherein a distance between rearward ends of the wedge surfaces is less than a diameter of the bore.

5. The assembly according to claim 1, wherein each of the wedge surfaces has an upper surface located at an elevation below a lower edge of the fist blade.

6. The assembly according to claim 1, wherein each of the blades has a length between outboard ends that is less than a diameter of the bore.

7. The assembly according to claim 1, further comprising:

a pair of recesses on the second ram block adjacent opposite ends of the blade of the second ram block for receiving the guide arms when the first and second ram blocks move to the closed position; wherein each of the recesses has a flat upper wall; and the guide arms are mounted to the first ram block so as to avoid sliding contact with the upper walls as the first and second ram blocks move to the closed position.

8. The assembly according to claim 7, wherein each of the recesses has an open bottom and an open outboard side.

9. The assembly according to claim 8, wherein each of the recesses has a flat inner side wall that is in a plane perpendicular to the upper wall.

10. A pipe shear ram assembly, comprising:

a housing having a bore extending vertically therethrough for the passage of a pipe string;

first and second ram blocks having first and second blades, respectively, the first and second blades being positioned such that one slides over the other when the first and second ram blocks are moved toward each other along a longitudinal axis of the first and second ram blocks to a closed position;

a pair of guide arms extending from the first ram block, the guide arms having tips protruding from the first ram block toward the second ram block a greater distance than the first blade;

each of the guide arms having an inboard wedge surface beginning at the tip and extending toward the first ram block to a rearward end of the wedge surface along a line that intersects the longitudinal axis, each of the wedge surfaces being devoid of additional aligning structure from the tip to the rearward end for contact with and guiding the pipe string toward a bore axis of the bore in the event the first and second ram blocks are moved to the closed position; and each of the guide arms has an upper surface located at an elevation on the first ram that is lower than a lower surface of the first blade.

11. The assembly according to claim 10, wherein:

a distance between the wedge surfaces measured at the tips is substantially equal to a diameter of the bore.

12. The assembly according to claim 10, wherein;

a distance between the wedge surfaces measured at the rearward ends is substantially equal to a length of the first blade.

13. The assembly according to claim 10, wherein:

each of the guide arms has an inboard side portion extending from the first ram block to a junction with the wedge surface, each of the inboard side portions being substantially parallel with the longitudinal axis; and a distance between inboard side portions is substantially equal to a length of the first blade and is less than a diameter of the bore.

14. The assembly according to claim 10, wherein;

the first blade extends over the second blade while the first and second ram blocks are in the closed position.

15. The assembly according to claim 10, further comprising:

a pair of recesses in the second ram block adjacent outboard ends of the second blade for receiving the guide arms when the first and second ram blocks move to the closed position; wherein each of the recesses has a downward-facing flat upper wall; and the guide arms are mounted to the first ram block so as to avoid sliding contact with the upper walls as the first and second ram blocks move to the closed position.

16. A pipe shear ram assembly, comprising:

a housing having a bore extending vertically therethrough for the passage of a pipe string;

first and second ram blocks having first and second blades, respectively, the first and second blades being positioned such that one slides over the other when the first and second ram blocks are moved toward each other along a longitudinal axis of the first and second ram blocks to a closed position;

a pair of guide arms, each having a base joined to the first ram block, an inboard side portion extending from a forward end of the inboard side portion at an angle relative to the longitudinal axis; wherein a distance between the forward ends of the side portions is approximately a same distance as a length of the first blade measured between outboard ends and is less than a diameter of the bore: a distance between forward ends of the wedge surfaces is approximately a same distance as the diameter of the bore, a pair of recesses in the second ram block adjacent outboard ends of the second blade for receiving the guide arms when the first and second ram blocks move to the closed position, each of the recesses being defined by at least one recess wall; and wherein the guide arms are mounted to the first ram block so as to avoid sliding contact with the recess walls as the first and second ram blocks move to the closed position.

17. A pipe shear ram assembly, comprising:

a housing having a bore extending vertically therethrough for the passage of a pipe string;

first and second ram blocks having first and second blades, respectively, the first and second blades being positioned such that one slides over the other when the first and second ram blocks are moved toward each other along a longitudinal axis of the first and second ram blocks to a closed position;

a pair of guide arms, each having a base joined to the first ram block, an inboard side portion extending forward from the base parallel with the longitudinal axis, and an inboard wedge surface extending from a forward end of the inboard side portion at an angle relative to the longitudinal axis; wherein a distance between the forward ends of the side portions is approximately a same distance as a length of the first blade measured between outboard ends and is less than a diameter of the bore;

a distance between forward ends of the wedge surfaces is approximately a same distance as the diameter of the bore; and each of the guide arms has an upper surface located at an elevation on the first ram that is lower than a lower surface of the first blade.

18. The assembly according to claim 16, wherein:

the first blade extends over the second blade while the first and second ram blocks are in the closed position; and the guide arms are located at a lower elevation on the first ram block than the first blade.

19. The assembly according to claim 17 wherein the wedge surface is flat and located in a vertical plane.

* * * * *

UNITED STATES PATENT AND TRADEMARK OFFICE

CERTIFICATE OF CORRECTION

PATENT NO. : 8,464,785 B2
APPLICATION NO. : 13/339519
DATED : June 18, 2013
INVENTOR(S) : Carbaugh et al.

It is certified that error appears in the above-identified patent and that said Letters Patent is hereby corrected as shown below:

In the Specification:

In Column 3, Line 24, delete "atm" and insert -- arm --, therefor.

In Column 4, Line 41, delete "not shown)." and insert -- (not shown). --, therefor.

In Column 4, Line 60, delete "rain" and insert -- ram --, therefor.

In the Claims:

In Column 5, Line 52, in Claim 1, delete "blocks," and insert -- blocks --, therefor.

In Column 6, Line 11, in Claim 4, delete "between" and insert -- between the --, therefor.

In Column 6, Line 15, in Claim 5, delete "fist" and insert -- first --, therefor.

In Column 6, Line 61, in Claim 12, delete "wherein;" and insert -- wherein: --, therefor.

In Column 7, Line 6, in Claim 14, delete "wherein;" and insert -- wherein: --, therefor.

In Column 7, Line 30, in Claim 16, delete "portion extending" and insert -- portion extending forward from the base parallel with the longitudinal axis, and an inboard wedge surface extending --, therefor.

In Column 7, Line 36, in Claim 16, delete "bore:" and insert -- bore; --, therefor.

Signed and Sealed this
Third Day of September, 2013

Teresa Stanek Rea
*Acting Director of the United States Patent and Trademark Office*